US009480320B1

(12) United States Patent
Pazdra

(10) Patent No.: US 9,480,320 B1
(45) Date of Patent: Nov. 1, 2016

(54) LIGHTED HAIR CLIP ASSEMBLY

(71) Applicant: Courtney L. Pazdra, Long Grove, IL (US)

(72) Inventor: Courtney L. Pazdra, Long Grove, IL (US)

( * ) Notice: Subject to any disclaimer, the term of this patent is extended or adjusted under 35 U.S.C. 154(b) by 0 days.

(21) Appl. No.: 14/246,304

(22) Filed: Apr. 7, 2014

(51) Int. Cl.
*A45D 8/00* (2006.01)

(52) U.S. Cl.
CPC ..... *A45D 8/00* (2013.01)

(58) Field of Classification Search
CPC ..... A45D 8/00; A45D 8/34; A45D 8/02; A45D 8/06; A45D 8/12
USPC ..... 132/273–283
See application file for complete search history.

(56) References Cited

U.S. PATENT DOCUMENTS

| | | | | |
|---|---|---|---|---|
| 1,480,009 | A * | 1/1924 | Preston | A45D 8/00 132/275 |
| 2,795,233 | A * | 6/1957 | Zore | 132/276 |
| 2,798,148 | A * | 7/1957 | La Greca | A44C 7/00 362/103 |
| 4,998,186 | A * | 3/1991 | Cocca | 362/103 |
| 2004/0163660 | A1 * | 8/2004 | Kellmann | 132/201 |

* cited by examiner

*Primary Examiner* — Rachel Steitz
(74) *Attorney, Agent, or Firm* — Dillis V. Allen, Esq.

(57) ABSTRACT

A decorative lighted hair clip assembly with a base housing upon which an LED and a decoration are mounted, with an internal circuit in the housing driven by a removable battery in the housing with a hair clip extending radially outwardly from the housing that facilitates the insertion of the clip assembly into the hair by grasping the housing and operating the clip. The fabric decoration surrounds the LED and is translucent.

13 Claims, 2 Drawing Sheets

28
32
35
16
21
41
24
22
20
46
44
42

38a
20
14
16
18
38
12
26
25
10
28

LIGHTED HAIR CLIP ASSEMBLY

BACKGROUND OF THE INVENTION

Lighted hair clips have achieved commercial success over the last decade in part because of the compactness and low amperage requirements of LED. Many of these have included decorative items adjacent the lights such as mock flower blooms. Most of these have included clips that take the form of hinged barrette-type clips. The problem with these devices is the decorative elements interfere with the installation and removal of the clip, or at least make installation and removal more difficult than the clip without the light decoration.

A preliminary search unveiled the following prior art:

| United States Patents | | |
|---|---|---|
| Inventor | Pat. No. | Issue Date |
| Cocca | 4,998,186 | Mar. 5, 1991 |
| Holce | 6,302,554 | Oct. 16, 2001 |
| Foreign | | |
| Japanese, | 201220291642.8, | Jun. 20, 2012. |
| | CN 202623779, | Dec. 26, 2012 |
| Japanese, | 200620027279.3, | Sept. 11, 2006 |
| | CN 200947830Y, | Sept. 19, 2007 |

It is a primary of object of the present invention to ameliorate the above discussed problems in commercially known lighted hair clip assemblies.

SUMMARY OF THE PRESENT INVENTION

In accordance with the present invention a lighted hair clip assembly is provided with a base housing upon which an LED and a decoration are mounted, with an internal circuit in the housing driven by a removable battery in the housing with a hair clip extending radially outwardly from the housing that facilitates the insertion of the clip assembly into the hair by grasping the housing and operating the clip. The decoration surrounds the LED and is translucent.

The clip extends radially outwardly from the housing and is generally in the same plane as the housing so the user can install the clip assembly by grasping the housing and operating the clip with a finger. The clip is also formed without a hinge so one clip member is operated by bending the member out of a plane of the other clip member, simplifying the clip installation and removal.

Other objects and advantages will appear more clearly from the following detailed description.

DETAILED DESCRIPTION OF THE PREFERRED EMBODIMENT

Figures 1, 2, 3:
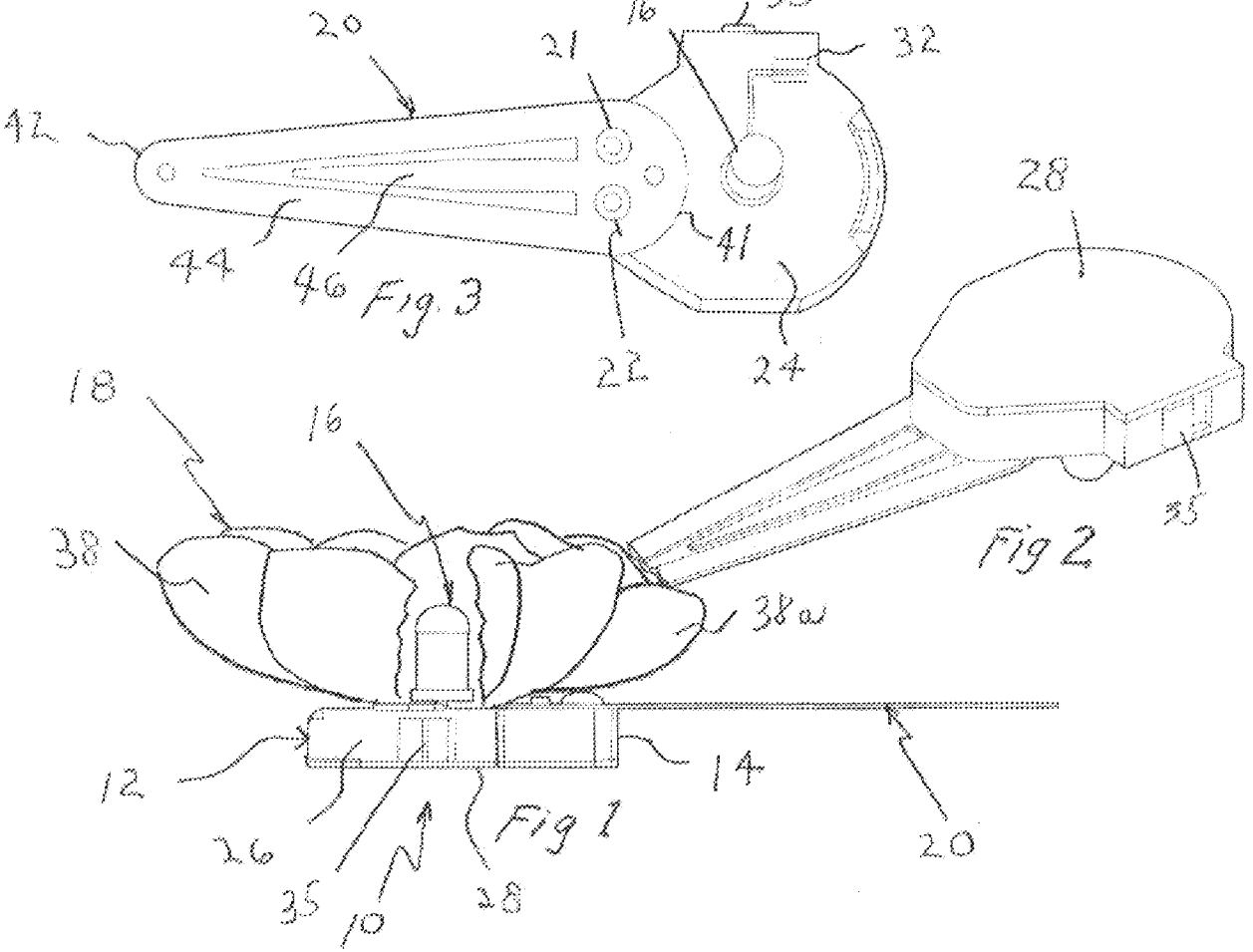
FIG. 1 is a front view of the present lighted hair clip assembly with the decoration partly broken away to illustrate the LED.
FIG. 2 is a bottom perspective of the lighted hair clip assembly illustrated in FIG. 1 at a slightly smaller scale.
FIG. 3 is a top view of the lighted hair clip assembly illustrated in FIG. 1 without the decoration.
Figure 5:
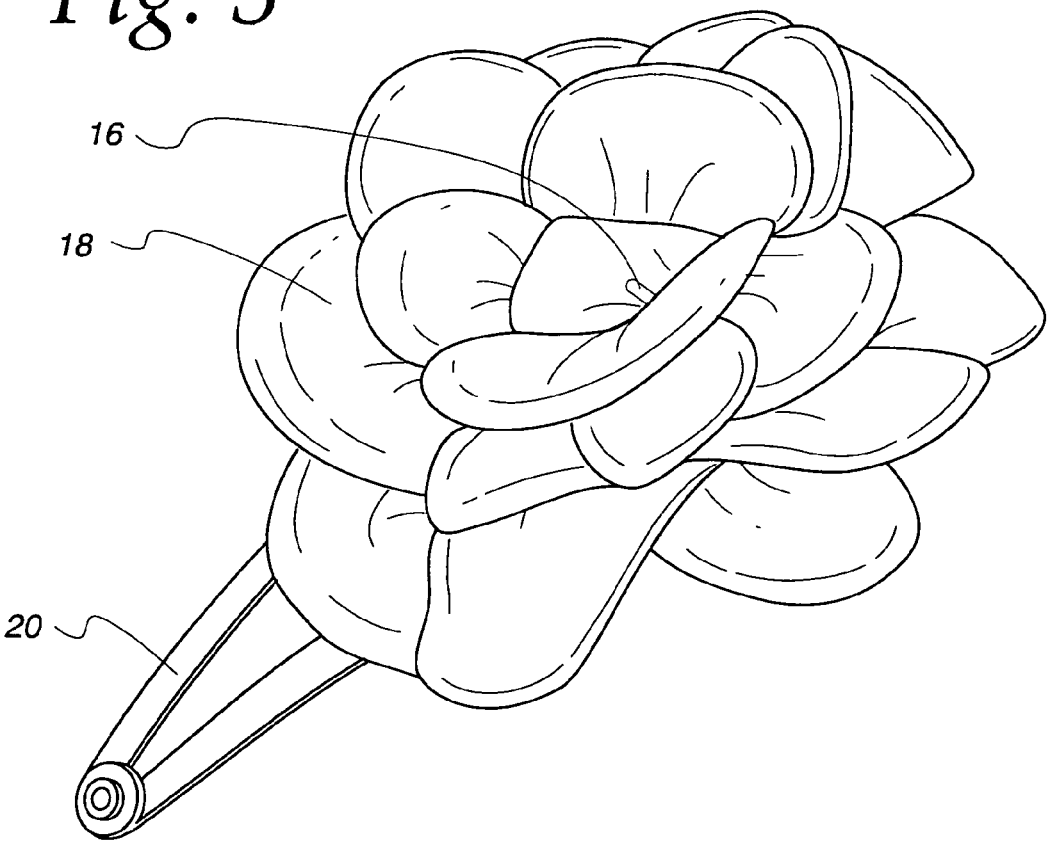
FIG. 5 is a photograph of the present lighted hair clip assembly installed or mounted on the fragmented hair of the user.

Referring to the drawings and particularly FIGS. 1 to 3, the present lighted hair clip assembly is generally designated by the reference numeral 10 and is seen to include a generally circular base 12 with a housing 14, an elongated lighted LED 16 projecting upwardly from housing 14, a floral decoration 18 surrounding the LED and more accurately depicted in FIG. 5, and an elongated clip 20 extending radially outwardly from the housing 14 and attached to the top surface of the housing 14 by rivets 21 and 22 shown in FIG. 3.

Figure 4:
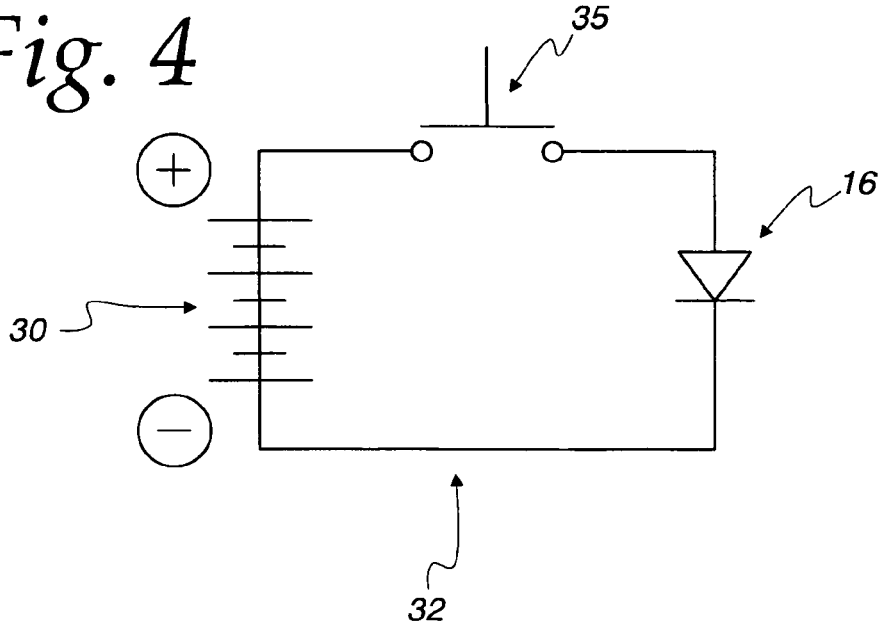
FIG. 4 is a schematic circuit contained in the housing illustrated in FIGS. 1 to 3.

The base 12, and more particularly the housing 14, includes a top wall 24, a generally circular peripheral wall 26, and a bottom wall 28 (FIG. 2). The bottom wall 28 is removable to replace a battery 30 (FIG. 4), that drives the LED circuit 32 illustrated in FIG. 4 and depicted as a circuit board circuit 32 in FIG. 3. The battery 30 may take the form of either a triple A battery or a circular watch-type battery, such as C2024.

An externally operated toggle switch 35 permits the user to switch the battery circuit 32 on or off to energize the lighted LED 16.

The decoration 18 can take a variety of forms, but the one depicted in the present drawings is a flower blossom consisting of a plurality of annular petals 38 that are affixed to the upper surface of the LED 16, and the petals 38A at the clip end of the housing 14 extend over the clip to partially hide the clip from view as can be seen more clearly in the photograph of FIG. 5.

The clip 20 is an unhinged-type clip and is formed from a flat metal stamping and as can be seen more clearly in FIG. 3, has a generally tapered configuration with an enlarged arcuate proximal end 41 and a distal end 42. The clip 20 is formed from a single sheet metal stamping having a thickness of approximately 1/32 inches. The outer isosceles portion 44 of the clip defines the upper portion of the clip as seen in FIG. 5, while a triangular inner or lower portion 46 defines the lower member of the clip 20. The entire sheet metal clip 20, while shown flat and planar in FIG. 1, may be bent by the user to conform to the shape of the hair configuration to which the lighted hair clip assembly is to be installed, such as shown in the FIG. 5 installation. The inner and lower clip member 46 is bendable from the plane of the outer clip portion 44 downwardly from its FIG. 1 configuration so that it may be slipped under the hair and then released to clamp the hair between the lower clip member 46 and the upper clip member 44 to hold the present lighted clip hair assembly in position.

The drawings, of course, are not to scale, but the outer dimension of the housing 14 is approximately 2.2 inches, and the length of the clip 20 projecting from the housing 14 is approximately 3 inches.

An important aspect of the present invention is that the clip 20 extends radially outwardly from the housing 14 so that the user, in installing the present lighted hair clip assembly, grasps the housing 14 with her fingers and at the same time depresses the inner clap member 46 downwardly and inserts the clip 20 into the hair as shown in FIG. 5, releasing the lower clip member 46 and clamping the user's hair between the lower clip member 46 and the upper clip member 44 to hold the lighted hair clip assembly in its proper position. The lighted hair clip assembly is released with a reverse motion by grasping the housing 14 and depressing the lower clip member 46 downwardly releasing the clip 20 from the hair and withdrawing the lighted hair clip assembly 10 from the hair moving to the right as shown in FIG. 1.

The invention claimed is:

1. A decorative lighted hair clip assembly, comprising: a generally circular base housing having side walls enclosing an electronic circuit, a battery concealed in the housing connected to drive the circuit, a vertical light mounted on one side of the base and connected to the electronic circuit, a translucent flower decoration mounted on the base and completely surrounding the light, and a clip separate from the base and extending generally outwardly from the base housing, said flower decoration extending over and concealing a portion of the hair clip, said clip being a depressible clip having an end, said translucent flower decoration extending short of the end of the clip so the clip end may be operated without obstruction.

2. A decorative lighted hair clip assembly as defined in claim 1, wherein the clip has an upper clip member and a lower clip member, so the assembly may be installed in the user's hair by the user grasping the housing base and operating the clip with one of the user's fingers.

3. A decorative lighted hair clip assembly as defined in claim 2, wherein the clip is hingeless and the upper clip member is integral with the lower clip member.

4. A decorative lighted hair clip assembly as defined in claim 2, wherein the clip is formed from a one-piece member and the upper clip member surrounds the lower clip member.

5. A decorative lighted hair clip assembly as defined in claim 2, wherein the clip is tapered with a large end attached to the housing and a small end adapted to be inserted into the hair when installing the clip assembly.

6. A decorative lighted hair clip assembly as defined in claim 1, including a battery cartridge in the base housing.

7. A decorative lighted hair clip assembly as defined in claim 1, including a switch assembly mounted in the base housing connected to the circuit to turn the light on and off.

8. A decorative lighted hair clip assembly as defined in claim 1, wherein the light is an LED.

9. A decorative lighted hair clip assembly as defined in claim 8, wherein the translucent flower decoration extends at least partly over the clip.

10. A decorative lighted hair clip assembly as defined in claim 1, wherein the translucent flower decoration is made of a fabric.

11. A decorative lighted hair clip assembly, comprising: a generally circular base housing enclosing an electronic circuit, a battery concealed in the housing connected to drive the circuit, a vertical light mounted on one side of the base and connected to the electronic circuit, a translucent flower decoration mounted on the base and completely surrounding the light, and a clip extending generally outwardly from the base housing having an upper clip member and a lower clip member, so the assembly may be installed in the user's hair by the user grasping the housing base and operating the clip with one of the user's finger, wherein the clip is hingeless and the upper clip member is integral with the lower clip member, wherein the clip is formed from a one-piece member and the upper clip member surrounds the lower clip member and a switch mounted on the housing connected to the electronic circuit, said translucent flower decoration extending short of an end of the clip so the clip may be operated without obstruction.

12. A decorative lighted hair clip assembly as defined in claim 11, wherein the translucent flower decoration extends at least partly over the clip.

13. A decorative lighted hair clip assembly, comprising: a generally circular base housing enclosing an electronic circuit, a battery concealed in the housing connected to drive the circuit, a light mounted on one side of the base and connected to the electronic circuit, a translucent flower decoration mounted on the base and completely surrounding the light, and a clip extending generally outwardly from the base housing having an upper clip member and a lower clip member, so the assembly may be installed in the user's hair by the user grasping the housing base and operating the clip with one of the user's finger, including a battery cartridge in the base housing, and a switch assembly mounted in the base housing connected to the circuit to turn the light on and off, said translucent flower decoration extending short of an end of the clip so the clip may be operated without obstruction.

* * * * *